United States Patent [19]

Kuehnle

[11] 4,435,071

[45] Mar. 6, 1984

[54] METHOD AND MEANS FOR REDUCING FRAME EFFECT IN ELECTROGRAPHIC IMAGES ON MICROFICHE

[76] Inventor: Manfred R. Kuehnle, 6 Linmoor Ter., Lexington, Mass. 02173

[21] Appl. No.: 246,811

[22] Filed: Mar. 23, 1981

Related U.S. Application Data

[63] Continuation of Ser. No. 941,658, Sep. 11, 1978, abandoned, which is a continuation of Ser. No. 716,591, Aug. 23, 1976, abandoned, which is a continuation-in-part of Ser. No. 646,004, Jan. 2, 1976, abandoned, which is a continuation of Ser. No. 481,133, Jun. 20, 1974, abandoned.

[51] Int. Cl.[3] ..... G03G 15/10

[52] U.S. Cl. ..... 355/10; 355/3 DD; 355/74; 355/77; 118/659; 430/117

[58] Field of Search ..... 355/3 DD, 3 R, 5, 7, 355/10, 16, 74, 3 CH, 3 SH, 77; 118/659, 636, DIG. 23; 430/31, 120–123, 117–119

[56] References Cited

U.S. PATENT DOCUMENTS

| | | | |
|---|---|---|---|
| 3,749,859 | 7/1973 | Sato | 427/15 X |
| 3,784,301 | 1/1974 | Sato | 355/7 |
| 3,791,345 | 2/1974 | McCutcheon | 427/15 X |
| 3,862,618 | 1/1975 | Sato et al. | 427/15 X |
| 3,964,436 | 6/1976 | Plumadore | 427/15 X |
| 3,972,610 | 8/1976 | Gross et al. | 355/7 |

*Primary Examiner*—Richard L. Moses

*Attorney, Agent, or Firm*—Cesari and McKenna

[57] ABSTRACT

An electrographic recording technique obtains superior image definition by providing a charged border around the image area of the recording medium and directing toner across the face of the medium at an appreciable velocity so that the toner particles are preferably attracted to unexposed areas of the medium and the charged border rather than to fully exposed areas of the medium.

13 Claims, 5 Drawing Figures

METHOD AND MEANS FOR REDUCING FRAME EFFECT IN ELECTROGRAPHIC IMAGES ON MICROFICHE

RELATED APPLICATIONS

This application is a continuation of my copending application, Ser. No. 941,658, filed Sept. 11, 1978 now abandoned, which was a continuation of my prior application Ser. No. 716,591, filed Aug. 23, 1976 (now abandoned), which was a continuation-in-part of my prior application Ser. No. 646,004, filed Jan. 2, 1976 now abandoned, which is a continuation of application Ser. No. 481,133, filed June 20, 1974, now abandoned.

BACKGROUND OF THE INVENTION

This invention relates to improvements in electrographic recording. It relates more particularly to a method and means for improving electrographic images.

When information is recorded on an electrographic storage medium such as a film or fiche, an area of the medium, referred to herein as the frame area, is electrostatically charged. Then the entire frame is exposed to a light image. Those portions of the frame area which are illuminated—corresponding to the light areas on the original—lose their charge. These portions corresponding to the dark areas of the original retain their charge, so that a latent image is impressed on the frame area. Following this, toner in the form of electroscopic powder or the like is applied to the frame to make the latent image visible and the toner is then fused to the medium to make the image permanent.

When the toner is applied to the latent image on the medium, it has a tendency to migrate laterally across an evenly charged frame area on the medium towards the edges of that area. This gives rise to a so-called "frame effect" which occurs because of the inability to completely discharge the background of the medium to low voltages by exposing the medium to light. Also, the background voltage on the film terminates with a sharp transient at the edge of the medium frame where the medium contacts the "charging window" formed by a conductor at the processing station. Toner particles tend to accumulate at the site of the voltage transient, causing a general darkening of the image outline on the medium that spoils the image.

It has been proposed to avoid this problem by providing a charged border around the image area. The effect of the charged border is to minimize the residual charge on the fully exposed portions of the latent image. In some cases the charge is equal to the initial charge impressed on the medium as described in U.S. Pat. Nos. 3,140,945, and 3,671,121. In others, it is greater as described in U.S. Pat. No. 3,883,349.

The provision of such a charged border does alleviate the problem to some extent. However some general darkening of the image area still occurs and spoils image definition, particularly when the medium is charged to a high potential. Also the adverse effects become more noticeable when larger image areas are exposed.

It is believed the problem stems from the inability of the charged border to offset the effects of the high residual voltage that is present on such film with a high initial charge. In other words, when toner is applied to the film during the developing step, a large percentage of the toner particles never "see" or are attracted by the border charge and are thus captured by the high residual charge on fully exposed portions of the image area thereby darkening the background. This "visibility" problem, of course, becomes more aggrevated as the size of the image area increases.

SUMMARY OF THE INVENTION

Thus the present invention aims to provide a method for improving the quality of the images impressed on electrographic storage media such as film and microfiche.

Another object of the invention is to provide a method for materially reducing the general darkening of such media and the "frame effect", even when the medium has a high initial charge.

A further object of the invention is to provide a method for distinctly defining each frame on an electrographic film or fiche.

Still another object of the invention is to provide an electrographic storage system which eliminates the background darkening and "frame effect" on such electrographic storage media.

Other objects will in part be obvious and will in part appear hereinafter.

The invention accordingly comprises the several steps and the relation of one or more of such steps with respect to each of the others and the apparatus embodying the features of construction, combination of elements and arrangement of parts which are adapted to effect such steps, all as exemplified in the following detailed description, and the scope of the invention will be indicated in the claims.

Briefly, when forming locally charged areas on a film or fiche to record data on those areas, the frame area is defined by an electrical conductor forming a window and against which the fiche is pressed. During the charging step in the recording process, an electrostatic charge is impressed only onto the frame area outlined by that conductor. Using my technique, during the imaging step in the recording process, a light image is impressed onto the fiche over an image area whose area is smaller than and disposed within that frame area, thereby leaving a border encircling the image area. This border comprises that portion of the frame area between the image area and the conductor which forms the window. The border never receives light and therefore remains highly charged.

Further, during the toning step, liquid or powder toner is preferably directed across the surface of the film or fiche at an appreciable velocity, so that all toner particles have an opportunity to "see" and be exposed to either an unexposed or partially exposed area of the latent image or the charged border area. Consequently, particles that do not adhere to unexposed portions of the image area still have sufficient momentum across the surface of the medium that they are preferably attracted by the border charge rather than by the residual charge on fully exposed portions of the image area, particularly near the edges of the image area.

As a general rule, the toner velocity across the medium should vary with the amount of residual charge on the medium. For low charging potential (e.g. 400 V) film characterized by a low residual charge upon exposure (e.g. 30 to 50 V), the toner may simply be deposited onto the film in the usual way. In that case, the conventional border change may be sufficient to sweep up the excess toner and avoid the "frame effect". Even there, however, as the image area on the medium becomes larger, the border charge becomes less effective because more and more toner particles, having no appreciable velocity, never "see" the border charge and so are captured by the residual charge on fully exposed areas of the medium.

For film characterized by a high charging potential (e.g. 2500 V) and high residual or background charge (e.g. 400 to 800 V) the toner should have an appreciable velocity vector across the medium to produce an image devoid of the "frame effect" and with good image definition. The removal of the excess toner from the image background to the charged border, of course, forms a sharp, narrow black border around the image which clearly delineates the image from others on the fiche.

This method of recording information on electrographic storage media can be carried out with a more or less standard recording system which projects a light image on a fiche. However it should be modified so that toner can be directed across the surface of the film at various rates and also to provide a narrow, non-illuminated border within the frame area and enclosing the image area. This border may be produced by limiting the projections of images onto the film to an image area which is less than and wholly within the frame area, or by using a suitable mask to so limit the image area. The mask can be positioned adjacent the inner edge of the electrical, window-defining conductor so that it establishes the focal plane of the fiche, outlines the image area, and also forms a seal against toner.

My technique greatly improves the quality of electrographic images on film and fiche. Yet, the incorporation of this feature in conventional electrographic recording systems should not materially increase the overall cost of the equipment.

BRIEF DESCRIPTION OF THE DRAWING

For a fuller understanding of the nature and objects of the invention, reference should be had to the following detailed description taken in connection with the accompanying drawing, in which.

DESCRIPTION OF THE PREFERRED EMBODIMENT

Figure 1:
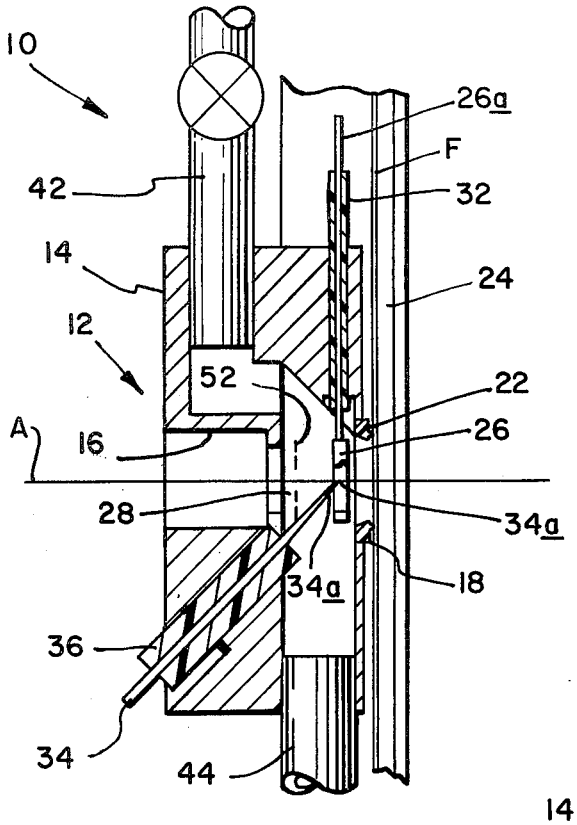
FIG. 1 is a fragmentary perspective view with parts in section showing an electrographic recording system for carrying out the method and embodying the principles of this invention.

Referring to FIG. 1 of the drawing, an electrographic recording system indicated generally at 10 has a film processing station 12 at which an electrographic fiche F is charged, exposed and developed to produce permanent xerographic images on the fiche. Processing station 12 is similar to the one described in detail in U.S. Pat. No. 3,820,890, entitled INFORMATION STORAGE AND RETRIEVAL SYSTEM. Consequently, its operation will not be discussed in detail here.

Suffice it to say that station 12 includes a housing 14 in the form of an electrically conducting block containing a lens assembly 16 with a lens axis A oriented substantially horizontally. A window 18 in the front of the housing is positioned directly opposite the lens assembly and is centered on lens axis A. A ring 22 of flexible, resilient, electrically insulating material such as neoprene extends around the edge of window 18.

The fiche F to be processed at station 12 is pressed against raised ring portion **22*a* so that portion 22*a* functions as a gasket and the fiche is held in position by a suitable platen 24 in the manner described in the aforesaid application. The platen and fiche are movable vertically and horizontally relative to lens axis A so that the different areas of the fiche can be brought into register with window 18** to record many different images on the fiche.

A ring electrode 26 is mounted in a cavity 28 inside housing 14 just inside window 18 and the ring is centered on the lens axis A. The ring electrode 26 has a lead **26*a* extending out of the housing, the lead being electrically insulated from the housing by an insulating sleeve 32. Also, a needle electrode 34 is mounted in the housing cavity so that its tip 34*a* is positioned at the center of the ring electrode on the lens axis A. The needle electrode also extends out of the housing and is insulated therefrom by means of an insulating sleeve 36**.

The application of a high potential across the two electrodes creates a corona discharge in the vicinity of the fiche F portion framed in window 18 so that an electrostatic charge is impressed on the photoconductive coating of the fiche frame area including the portions opposite ring 22. Alternatively the charge can be impressed on the fiche using other known techniques. The area thus changed is referred to herein as the "frame area. After the frame area is charged in this fashion, a light image of the source scene to be copied is impressed onto a portion of the charged image area within the fiche frame area. The portion of the frame area exposed by this source image is referred to herein as the "image area". The image area is completely confined within and bordered on its perimeter by portions of the frame area not exposed by the source image to be copied. In the illustrated embodiment, the light image is projected by lens assembly 16 onto the charged frame image area. Those portions of the frame on which light is incident are discharged, while those portions which are not so illuminated, including the portion opposite ring 22, remain charged.

Figure 3:
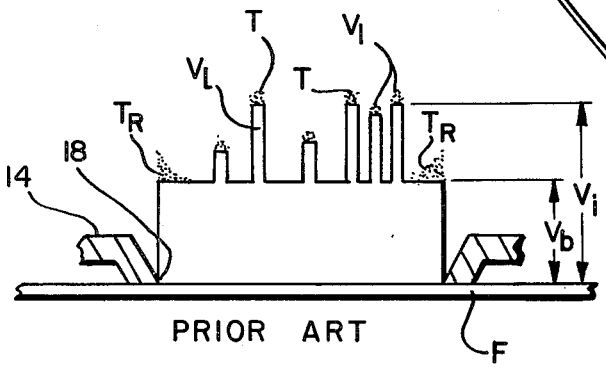
PRIOR ART FIG. 3
FIG. 3 is a view similar to FIG. 2 illustrating the operation of a prior art electrographic storage system.
Figure 3A:
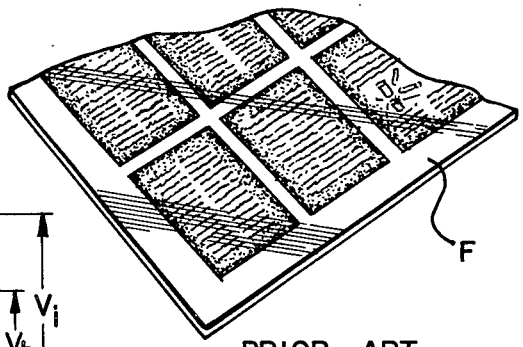
PRIOR ART FIG. 3A
FIG. 3A is a view similar to FIG. 2A showing the "frame effect" produced on an electrographic storage medium using the prior FIG. 3 system.

Turning for a moment to FIGS. 3 and 3A, conventionally during the charging step described above, a relatively uniform electrostatic charge is applied to the entire portion of the fiche F framed by window 18. On the other hand, the voltage on the portions of the fiche outside the window 18 which contact the conductive housing 14 is zero volts. This is indicated in FIG. 3 where the voltage $V_i$ represents the initial voltage impressed on the fiche during the charging step.

Upon exposure, the voltage across the fully illuminated parts of the fiche drops to a background level $V_b$. The intermediate voltage values $V_1$ represent those parts of the latent image corresponding to lines on the original document. Thus, the charge on the fully illuminated parts of the fiche never drops to zero volts. Rather, it falls only to a certain background or residual level $V_b$. Also, at the edges of the frame at the boundary of window 18, there is a positive going voltage transient, i.e. from voltage $-V_b$ (or $-V_1$) to zero volts. The background level $V_b$ may be as much as 800 volts or more in the case of some films.

When the toner particles T are applied to the fiche in the usual way, they tend to accumulate at those parts of the fiche still carrying a charge in proportion to the strength of the charge as indicated in FIG. 3. But randomly moving toner particles $T_R$ also tend to accumulate on fully exposed portions of the fiche still having a residual charge, especially at the edges of the frame. This problem is particularly prevalent in the case of high charging potential film and is aggravated as the image area becomes larger. These portions of the image background which are darkened in varying degrees spoil the appearance of the image on the fiche.

Figure 2:
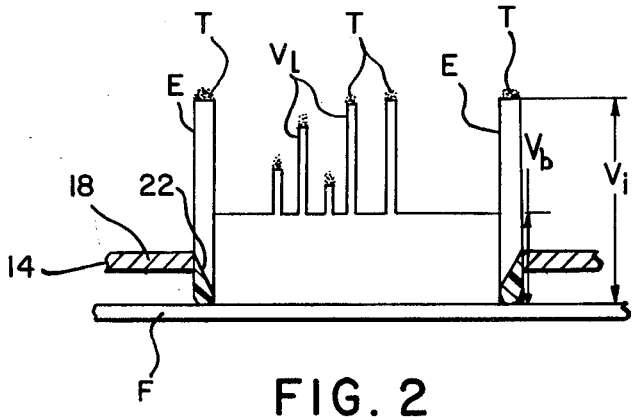
FIG. 2 is a diagrammatic view illustrating the operation of the present system.
Figure 2A:
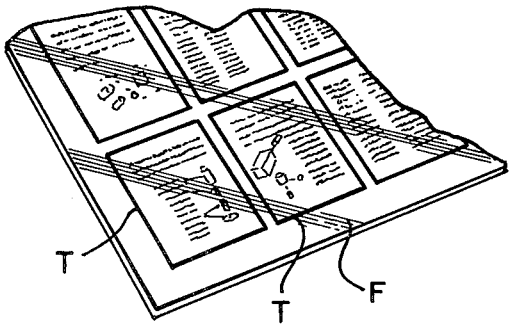
FIG. 2A is a pespective view of an image formed on an electrographic storage medium using this technique.

Using the present technique by contrast, that problem is eliminated by masking the fiche to provide a darkened border around the image area just inside the window 18. In the illustrated embodiment, this mask is provided by the insulating ring or gasket 22. The ring shields or masks an edge margin of the fiche just inside the window 18 from the incident light, so that the margin retains its electrical charge, as indicated at E in FIG. 2. The masked border can be U-shaped or, more preferably, will extend all around the image area.

Further, as best seen in FIG. 1 during the developing step, liquid toner is introduced into the housing cavity via a conduit having a valved inlet 42 and is exposed to the charged areas of the frame, including the region opposite ring 22 inboard of its portion 22*a*. More particularly, the toner issuing from conduit 42 is redirected by a right angle passage 46 toward a downwardly inclined surface 48 in housing 14 which guides the toner toward the top edge of the fiche F portion framed in window 18.

The toner thus flows or washes with appreciable velocity down over the entire surface of the fiche portion and excess toner is swept away via a conduit 44 in the bottom of housing 14. The flow rate of the toner over the fiche portion can be adjusted by the valve in inlet 42 and it preferably varies with the residual charge characteristic of the particular fiche being recorded on. It may also be varied depending upon the size of the image area on the fiche.

The application of liquid toner to the fiche so that it washes down over the surface of the fiche assures that each toner particle has an appreciable velocity vector. Thus as the particles are carried across the face of the fiche, they are less susceptable to being captured by the residual charge on the fully exposed portions of the fiche. Rather, each particle is now able to "see" and thus be exposed to the full or partial charge over a large part of the latent image and especially to the full charge on the unexposed border just inboard of ring portion 22*a*. Thus the toner particles are preferentially captured by the areas of the fiche that result in image development rather than background enhancement or darkening and by the charged border around the image. The result is an image on the fiche with superior definition that is free of the "frame effect". Also a distinctive, dark border is created around the image that separates it from adjacent images on the fiche.

Of course, a mask can be positioned elsewhere along the optical path between the original document and fiche F to create the darkened border between the image area on the fiche and the edges of the window 18. For example, it can be positioned inside cavity 28 as indicated in dotted lines at 52 in FIG. 1. So, too, the system optics can be arranged so that the image area is smaller than the frame area (i.e. window 18) so that a non-illuminated border exists on the fiche just inside the edge of window 18.

It will thus be seen that the objects set forth above, among those made apparent from the preceding description, are efficiently attained and, since certain changes may be made in carrying out the above method and in the construction set forth without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described.

I claim:

1. An electrographic recording system comprising:

A. means for impressing an electrostatic charge on the frame area of an electrographic storage medium;

B. means for exposing an image area within said frame area to a light image of an original so that the image area is smaller than the frame area, thereby forming a non-illuminated, charged boundary around the image area, said exposing means comprising a non-electrically conductive ring extending opposite said boundary, said ring (1.) establishing the focal plane of the exposing means, (2.) providing a seal against toner particles around the edge of the frame area, and (3.) masking the storage medium along said boundary from incident light; and C. means for directing toner particles along the surface of the medium with an appreciable velocity so that their momentums across the medium surface inhibit their tendency to be captured by the residual charge on fully exposed portions of the medium whereby they collect at the unexposed or only partially exposed portions of the image area and at said charged boundary so as to improve the quality of the image on the medium while simultaneously forming a sharp, distinct, uniform dark border around and touching the image area on the medium.

2. An electrographic recording system comprising:

A. means for impressing an electrostatic charge on a frame area of an electrographic storage medium;

B. means for exposing an image area within said frame area to a light image of a message source, or original, so that the image area is smaller than the frame area, said exposing means comprising means along the optical path from the original image to the medium for establishing an aperture shaped and arranged so that a light image of a message source, or original, is incident on a portion of the storage medium having an area which is less than the frame area and whose shape is similar to that of the frame area, thereby forming a non-illuminated, charged boundary around the image area,;

C. means for applying toner particles to the frame area, said charged boundary inhibiting the tendency of excess toner particles to be captured by the residual charge on fully exposed portions of the medium whereby they collect at the unexposed or only partially exposed portions of the image area and at said charged boundary, so as to improve the quality of the image on the medium while simultaneously forming a sharp, distinct, uniform dark border around and touching the image area on the medium; and D. means for confining the toner particles to the frame area so as not to prevent use of other portions of the medium for other frame areas.

3. An electrographic recording system for copying a message source, or original, on a fiche comprising:

A. means for impressing an electrostatic charge on a frame area of a fiche electrographic storage medium, wherein the frame area is only a small part of the fiche area;

B. means for exposing an image area within said frame area to a light image of a message source, thereby forming a non-illuminated, charged boundary in the frame area, around and in direct contact with the image area;

C. means for confining the toner particles to the frame area, whereby they collect at the unexposed or only partially exposed portions of the image area and at said charged boundary so as to improve the quality of the image on the medium while simultaneously forming a sharp, distinct, uniform dark border around and touching the image area on the medium and permitting other portions of the fiche arbitrarily close to such border to be used for other frame areas.

4. The electrographic recording system of claim 3 further including means for directing toner particles along the surface of the medium with an appreciable velocity so that their momentums across the medium surface inhibit their tendency to be captured by the residual charge on fully exposed portions of the medium.

5. The electrographic recording system of either claim 3 or claim 4, wherein the means for exposing an image area has a focal length such that the image of the message source is projected onto a portion of the fiche whose area is less than and wholly within the frame area.

6. An electrographic recording system of claim 3 wherein the means for exposing an image area further includes a non-electrically conductive ring extending opposite said boundary, said ring A. establishing the focal plane of the exposing means, B. providing a seal against toner particles around the edge of the frame area, and C. masking the storage medium along said boundary from incident light.

7. A method of recording an image on a fiche type electrographic storage medium comprising the steps of:

A. impressing an electrostatic charge on a frame area of the fiche medium, wherein the frame area is only a small part of the fiche area;

B. exposing an image area of the medium with a light image of a message source, or original, so that the image area is smaller than and wholly within the frame area, thereby forming a non-illuminated, charged boundary around and in direct contact with the image area just inside the periphery of the frame area;

C. applying toner particles to the frame area, the charged boundary inhibiting the tendency of excess toner particles to be captured by the residual charge on fully exposed portions of the medium whereby they collect at the unexposed or only partially exposed portions of the image area and at said charged boundary so as to improve the quality of the image on the medium; and D. confining the excess toner particles to the frame area, so that they form a sharp, distinct, uniform dark border around and in direct contact with the image area on the medium, just inside the periphery of the frame area, thereby permitting other portions of the fiche arbitrarily close to the frame area to be used as other frame areas.

8. The method of recording an image on a fiche type electrographic storage medium according to claim 17 wherein the step of exposing an image area comprises placing a mask along the optical path between the message source and the storage medium for establishing an aperture shaped and arranged so that a light image of the message source is incident on the storage medium and has an area which is less than the frame area and a shape similar to that of the frame area.

9. The method of claim 7 further including the steps of:

A. flowing toner particles as a liquid along the surface of the medium with an appreciable velocity so that their momentums across the medium surface inhibit their tendency to be captured by the residual charge on fully exposed portions of the medium, whereby they tend to collect on unexposed or only partially exposed portions of the image area and at said charged boundary thereby improving the image on the medium and forming a narrow distinctive border around and in direct contact with the image area; and B. controlling the rate of flow of toner across the medium surface in accordance with the background charge characteristic of the medium being recorded on.

10. The method of claim 9 further including, as part of the exposing step, positioning the storage medium relative to the source so that the focal plane of the image is coincident with the storage medium and the area of the image at the focal plane is less than the frame area.

11. A method of recording an image on a fiche electrographic storage medium comprising the steps of:

A. impressing an electrostatic charge on a frame area of the fiche medium, such frame area being only a small part of the total fiche area;

B. placing a mask along the optical path between the message source and the storage medium for establishing an aperture shaped and arranged so that a light image of the source is incident on the storage medium and has an area which is less than and wholly within the frame area, thereby forming a non-illuminated, charged boundary around and in direct contact with the image area just inside the periphery of the frame area;

C. directing toner particles as a liquid along the surface of the medium with an appreciable velocity so that their momentums across the medium surface inhibit their tendency to be captured by the residual charge on fully exposed portions of the medium whereby they collect at the unexposed or only partially exposed portions of the image area and charged boundary so as to improve the quality of the image on the medium while simultaneously forming a sharp, distinct, uniform dark border around and touching upon the image area on the medium; and D. confining the toner particles to the frame area, so as not to prevent use of other portions of the fiche for other frame areas.

12. The method of recording an image of a message source, or original, on an electrographic fiche storage medium comprising the steps of:

A. impressing an electrostatic charge on a frame area of the fiche medium, such frame area being only a small part of the fiche area;

B. exposing an image area of the medium, wholly within the frame area, with a light image of a message source;

C. directing toner particles over the frame area;

D. said exposing step including the step of positioning the storage medium relative to the message source so that the focal plane of the message source is coincident with the storage medium and the area of the image at the focal plane is less than the frame area of the medium, thereby forming a non-illuminated, charged boundary around the image area just inside the edges of the frame area, to inhibit the tendency of excess toner particles to be captured by the residual charge on fully exposed portions of the medium, so that they collect at the unexposed or only partially exposed portions of the image area and at said charged boundary, thereby improving the quality of the image on the medium while simultaneously forming a sharp, distinct, uniform dark border around and in direct contact with the image area on the medium; and E. confining the toner particles to the frame area.

13. The method defined in claim 12 and further including the step of fixing the toner applied to the medium.

* * * * *